US012569715B2

(12) United States Patent
Nolan et al.

(10) Patent No.: US 12,569,715 B2
(45) Date of Patent: Mar. 10, 2026

(54) RACK PULLEY SYSTEM FOR EXERCISE EQUIPMENT

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproff Fitness Equipment Inc, Acton, CA (US)

( * ) Notice: Subject to any disclaimer, the term of this patent is extended or adjusted under 35 U.S.C. 154(b) by 58 days.

(21) Appl. No.: 18/772,476

(22) Filed: Jul. 15, 2024

(65) Prior Publication Data

US 2025/0018240 A1 Jan. 16, 2025

Related U.S. Application Data

(60) Provisional application No. 63/513,404, filed on Jul. 13, 2023.

(51) Int. Cl.
*A63B 21/00* (2006.01)

(52) U.S. Cl.
CPC ..... *A63B 21/154* (2013.01); *A63B 21/00069* (2013.01)

(58) Field of Classification Search
CPC ..... A63B 21/154; A63B 21/00069; A63B 21/4045; A63B 21/4043; A63B 23/1209; A63B 23/1218; A63B 23/1281; A63B 21/0626; A63B 21/4035; A63B 21/156; A63B 2225/093
See application file for complete search history.

(56) References Cited

U.S. PATENT DOCUMENTS

| | | | | | |
|---|---|---|---|---|---|
| 4,402,504 | A * | 9/1983 | Christian | A63B 21/156 482/129 |
| 8,172,733 | B1 * | 5/2012 | Batca | A63B 21/0628 482/99 |
| 10,486,010 | B1 * | 11/2019 | Leipheimer | A63B 21/078 |
| D893,639 | S * | 8/2020 | Henniger | D21/673 |
| D903,793 | S * | 12/2020 | Henniger | D21/673 |
| D919,017 | S * | 5/2021 | Henniger | D21/673 |
| 11,110,313 | B2 * | 9/2021 | Gore | A63B 21/078 |
| D935,311 | S * | 11/2021 | Xu | D8/360 |
| D948,641 | S * | 4/2022 | Henniger | D21/673 |
| D1,012,673 | S * | 1/2024 | Adams | D8/360 |
| D1,015,125 | S * | 2/2024 | Adams | D8/360 |

(Continued)

*Primary Examiner* — Andrew S Lo
(74) *Attorney, Agent, or Firm* — AVEK IP, LLC

(57) ABSTRACT

A rack pulley system for use with an exercise machine includes an upper pulley system to removably secure to a vertical post and having an upper housing mounted to an upper brace, the upper brace to engage with the vertical post; and upper cable guides supported by the upper housing and to support a cable traveling therethrough; a lower pulley system to removably secure to the vertical post and having a lower housing mounted to a lower brace, the lower brace to engage with the vertical post; and lower cable guides supported by the lower housing and to support the cable traveling therethrough; a trolley to engaged with the vertical post between the upper pulley system and the lower pulley system and to traverse along the vertical post, the trolley having a trolley cable guide to connect the trolley to the cable.

16 Claims, 4 Drawing Sheets

(56) References Cited

U.S. PATENT DOCUMENTS

| | | | | |
|---|---|---|---|---|
| 12,036,436 | B2 * | 7/2024 | Henniger | A63B 21/4029 |
| 12,303,731 | B1 * | 5/2025 | Yu | A63B 21/156 |
| 12,397,189 | B2 * | 8/2025 | McGrotty | A63B 21/154 |
| 2003/0115955 | A1 * | 6/2003 | Keiser | A63B 21/0087 73/379.06 |
| 2008/0287270 | A1 * | 11/2008 | Carter | A63B 23/12 482/99 |
| 2013/0035220 | A1 * | 2/2013 | Adams | A63B 21/4035 482/129 |
| 2013/0274075 | A1 * | 10/2013 | Habing | A63B 21/0628 482/102 |
| 2019/0134450 | A1 * | 5/2019 | Kuo | A63B 21/154 |
| 2020/0155889 | A1 * | 5/2020 | Leipheimer | A63B 21/00065 |
| 2020/0222745 | A1 * | 7/2020 | Leipheimer | A63B 23/03525 |
| 2022/0233909 | A1 * | 7/2022 | Williams | A63B 21/0628 |
| 2024/0307729 | A1 * | 9/2024 | Nolan | A63B 21/0626 |

* cited by examiner

RACK PULLEY SYSTEM FOR EXERCISE EQUIPMENT

CROSS REFERENCE TO RELATED APPLICATIONS

This application claims the benefit of priority of U.S. Provisional Application No. 63/513,404, filed Jul. 13, 2023, the disclosure of which is herein incorporated by reference in its entirety.

FIELD OF INVENTION

The disclosure relates generally to exercise equipment. More specifically, the disclosure relates to a rack pulley system that includes an upper pulley system and a lower pulley system with a cable removable from a trolley such that the trolley may be used with or without cable resistance.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes an exercise machine having a rack pulley system. The machine includes a vertical post, an upper pulley system, a lower pulley system, and a trolley. The upper pulley system is engaged with the vertical post and includes an upper housing mounted to an upper brace, the upper brace to engage with the vertical post; and a plurality of upper cable guides supported by the upper housing and configured to support a cable traveling therethrough. The lower pulley system is engaged with the vertical post at a position below the upper pulley system, the lower pulley system having a lower housing mounted to a lower brace, the lower brace to engage with the vertical post; and a plurality of lower cable guides supported by the lower housing and configured to support the cable traveling therethrough. The trolley engaged with the vertical post and configured to traverse along the vertical post at a position between the upper pulley system and the lower pulley system, the trolley having a trolley cable guide configured to connect the trolley to the cable. The trolley cable guide allows for removal of the cable from the trolley such that the trolley can be used with or without the cable; and the upper pulley system and lower pulley system are removed from the vertical post.

According to another embodiment of the current disclosure, the invention includes a rack pulley system for use with an exercise machine, the rack pulley system comprising an upper pulley system, a lower pulley system, and a trolley. The upper pulley system is configured to removably secure to a vertical post and includes an upper housing mounted to an upper brace, the upper brace to engage with the vertical post; and a plurality of upper cable guides supported by the upper housing and configured to support a cable traveling therethrough. The lower pulley system is configured to removably secure to the vertical post at a position below the upper pulley system and includes a lower housing mounted to a lower brace, the lower brace to engage with the vertical post; and a plurality of lower cable guides supported by the lower housing and configured to support the cable traveling therethrough. The trolley is configured to engage with the vertical post at a position between the upper pulley system and the lower pulley system and is further configured to traverse along the vertical post. The trolley includes a trolley cable guide configured to connect the trolley to the cable, wherein the trolley cable guide allows for removal of the cable from the trolley such that the trolley can be used with or without the cable.

BRIEF DESCRIPTION OF THE DRAWINGS

Embodiments of the invention are described in detail below with reference to the attached drawings.

LIST OF REFERENCES

Figure 1:
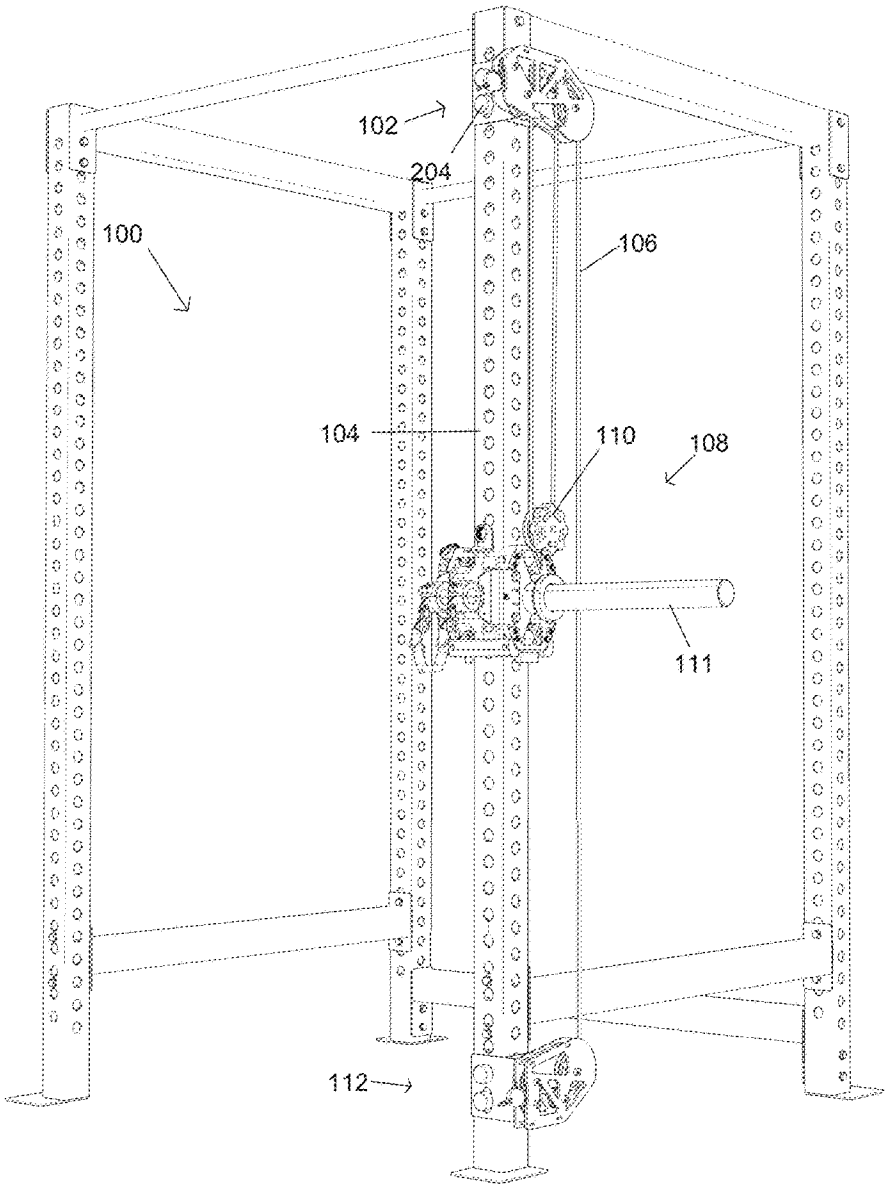
FIG. 1 is an angled view of an exercise machine with a rack pulley system in accordance with the present disclosure.

100—Rack Pulley System
102—Upper Pulley System
104—Vertical Post
106—Cable
108—Trolley
110—Trolley Cable Guide
111—Weight Sleeve
112—Lower Pulley System
200*a-d*-Cable Guides
202—Upper Cable End
204—Pin(s)
206—Bracket
208—Housing
300*a-d*—Cable Guides
302—Pin(s)
304—Lower Cable End
306—Bracket
308—Housing The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. Many exercise equipment utilize a cable system to create resistance such that as a user engages with a user engageable device, the cable provides resistance thereto, such as through connection to one or more weights or weight supporting devices. Many exercise equipment also utilize one or more vertical posts for supporting user engageable devices. For example, gyms (both commercial and home) generally use a frame with one or more vertical posts for supporting barbells or other equipment. In other words, it is common for gyms to already have a frame structure with vertical uprights available. Conventional cable machines are traditionally large, standalone units, taking up large footprints in a gym or office, and accordingly are not always suitable for small spaces and further not worth the footprint.

The present invention provides for a rack pulley system in which an upper pulley system and a lower pulley system are attached to a vertical post and support a cable extending therebetween. The upper and lower pulley systems are easily attached to the vertical post such that any conventional upright/frame system can support the pulley system. The present invention further utilizes a trolley, positioned along the vertical post at a position between the upper pulley system and the lower pulley system, the trolley supporting weight sleeve such that a user can add weight to the trolley. The trolley specifically is easy to couple to the cable, such that the trolley can be used with or without the cable. Again, the trolley here can be easily added to the vertical post such that no special upright system is needed, rather the user can easily add the system of the present application to conventional equipment. The upper pulley system and lower pulley system are each configured to receive one or more attachments such that high and low cable functions can be performed. For example, a user may add a handle attachment to the top or bottom and complete an exercise therewith. Accordingly, with minimal additions, a user can add an entire cable system, with a plurality of configurations, to a conventional upright/frame/vertical post. If the user decides to remove the system, the system can be easily stored.

The trolley of the present invention includes a trolley cable guide which is configured to connect the trolley to the cable such that the trolley can operate with the cable or without the cable. In other words, the user can attach the cable, add weight, and then use a device at the top or bottom end of the cable to complete an exercise, or, as desired, the user can disconnect the cable and add a user engageable device directly to the trolley (such as a handle) and use the trolley alone. Again, the attachment to the cable itself is seamless such that the trolley is easily connected thereto. This allows for a user to customize their use of the equipment. In the preferred embodiment, the upper pulley system, lower pulley system, and trolley are all mounted to a single vertical post.

As shown best in FIG. 1, the rack pulley system 100 includes the upper pulley system 102 engaged with the vertical post 104, a lower pulley system 112 engaged with the vertical post 104, and a trolley 108 engaged with the vertical post 104 at a position between the upper and lower pulley systems 102, 112. The upper pulley system 102 is mounted near a top end, while the lower pulley system 112 is mounted to a lower end, however, the exact locations of connection can vary. For example, although the upper pulley system 102 is shown mounted to the top two holes of the vertical post 104, and the lower pulley system 112 is shown mounted to the two bottom holes, slight changes are contemplated for positioning.

Those skilled in the art will appreciate that the trolley 108 may vary, but in most embodiments includes weight sleeve 111. The weight sleeve 111 allows for the user to add weighted resistance to the system. The trolley 108 also specifically includes one or more rollers that allow for the trolley to easily glide up and down the vertical post 104. The trolley can also include an attachment mechanism such that a user can attach handles, pads, or other components to the trolley.

Trolley 108 further includes a trolley cable guide 110 configured to connect the trolley 108 to a cable 106 and therefore couple the trolley 108 to the upper and lower pulley systems 102, 112. As shown best in FIG. 4, the cable 106 extends between all three. The trolley cable guide 110 allows for the cable 106 to be disconnected from the trolley 108 easily. For example, the user can merely retain the cable 106 in a position (simply hold with their hand), lift up on the weight sleeve 111 to allow the cable 106 to slack from the cable guide 110, and then disengage the two fully. In some embodiments, the trolley cable guide 110 is threaded such that it can loosen and tighten, thereby again allowing for easy engagement with the cable 106.

Figure 2:
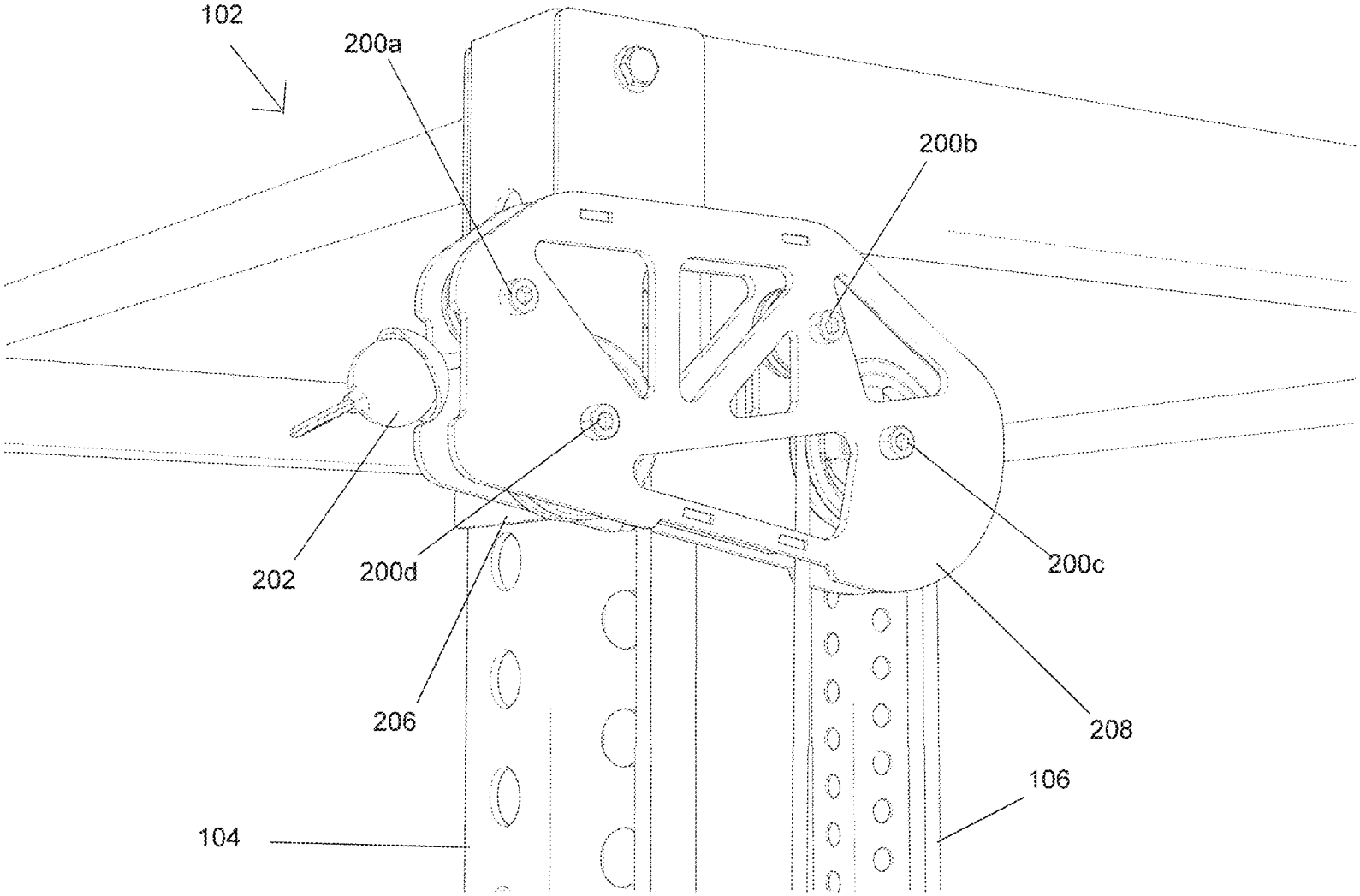
FIG. 2 is an angled view of a top pulley system in accordance with the present disclosure.

As best shown in FIG. 2, the upper pulley system 102 includes a housing 208 mounted to a bracket 206 which is further configured to mount to the vertical post 104. In embodiments, one or more pins 204 are used to create a secure mount, however, alternative means of mounting may be used. The one or more pins 204, in embodiments, are designed with a threaded end and flanged head such that they attach through the vertical post 104 and can be engaged and disengaged without any specialized tools. In other words, the use of pins, threaded or not, allows for easy mounting to the vertical post 104. This allows for the upper pulley system 102 and the lower pulley system 112 to be easily removed from the vertical post 104 such as for storage. The housing 208 supports a plurality of cable guides 200*a-d*, which allow for the cable 106 to extend therethrough to an upper end 202, where an attachment may be added as desired. Specifically, the cable 106 will travel between a top guide 200*a* and a bottom guide 200*d* and then in a downward direction (i.e. toward the trolley 108). The cable 106 then bends around back in an upward direction at the trolley 108 where it will re-enter the housing 208 and circle around a lower rear cable guide 200*c* and below an upper rear cable guide 200*b*. From there, as shown in FIG. 4, the cable 104 travels downward to the lower pulley system 112.

Figure 3:
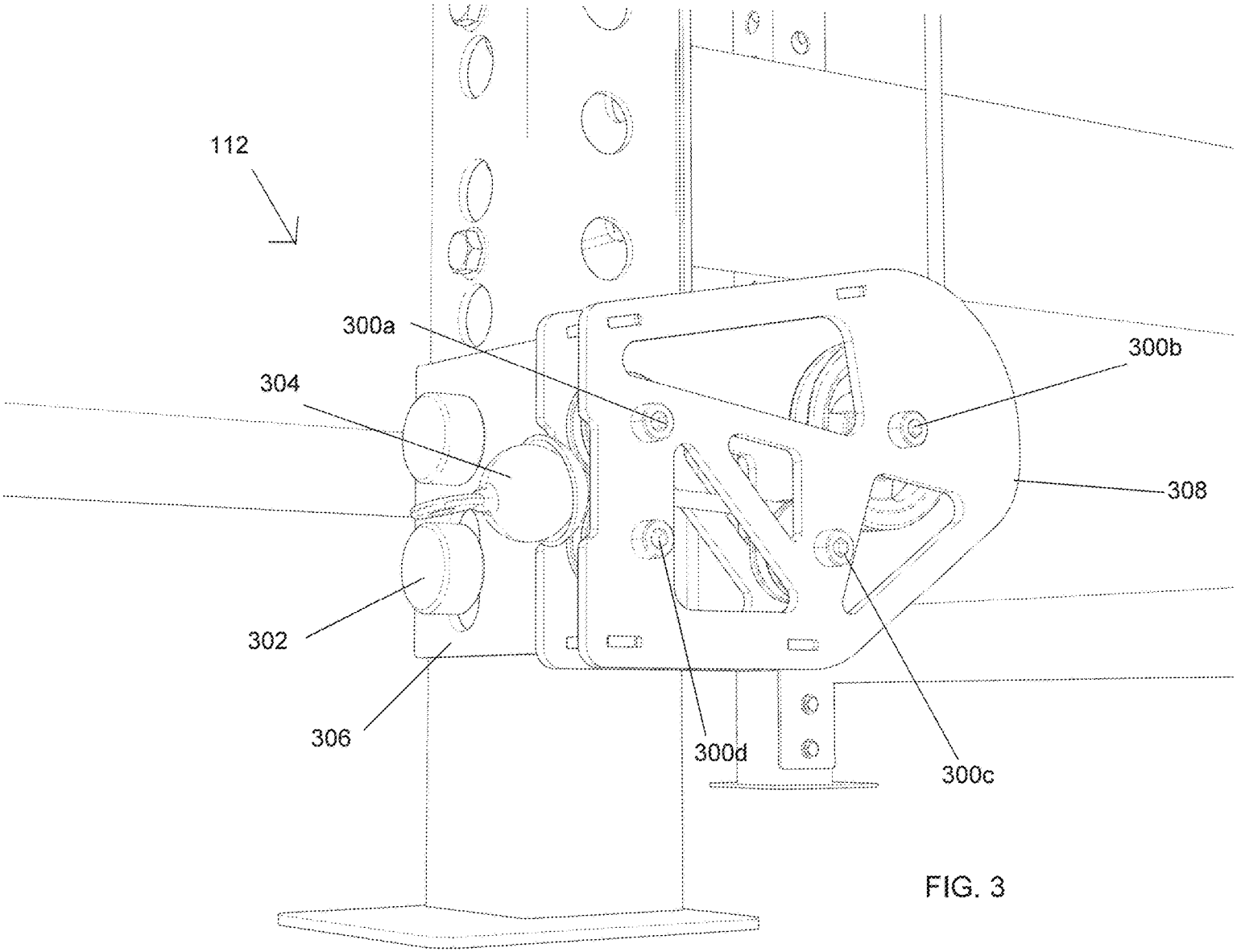
FIG. 3 is an angled view of a bottom pulley system in accordance with the present disclosure.

As shown in FIG. 3, lower pulley system 112 is similar to the upper pulley system 102 and includes a housing 308 mounted to a bracket 306 which is further configured to mount to the vertical post 104 such as through use of one or more pins 302. Again, the one or more pins 302 are configured for easy removal of the lower pulley system 112. The housing 308 supports a plurality of cable guides 300*a-d* such that the cable 106 extends therethrough to a lower end 304 to allow for attachments. Here, starting at the lower end 304, the cable travels between a top guide 300*a* and a bottom guide 300*d*, but instead of curving, the cable 106 continues rearward in between guides 300*b* and 300*c* before curving upward.

The primary components, namely the upper and lower pulley systems, 102, 112 and the trolley 108, independently attach to/detach from most square post rack setups via rack pins, which offers a tool-free, compact and minimal solution to integrate and/or retrofit a dual point, single cable high/low pulley system to most squat rack setups. Furthermore, the system 100 attaches to a rack-mounted trolley 106 to provide necessary weight resistance, allowing the trolley to be used independent from the system and expanding the range of exercises capable within a small footprint.

Figure 4:
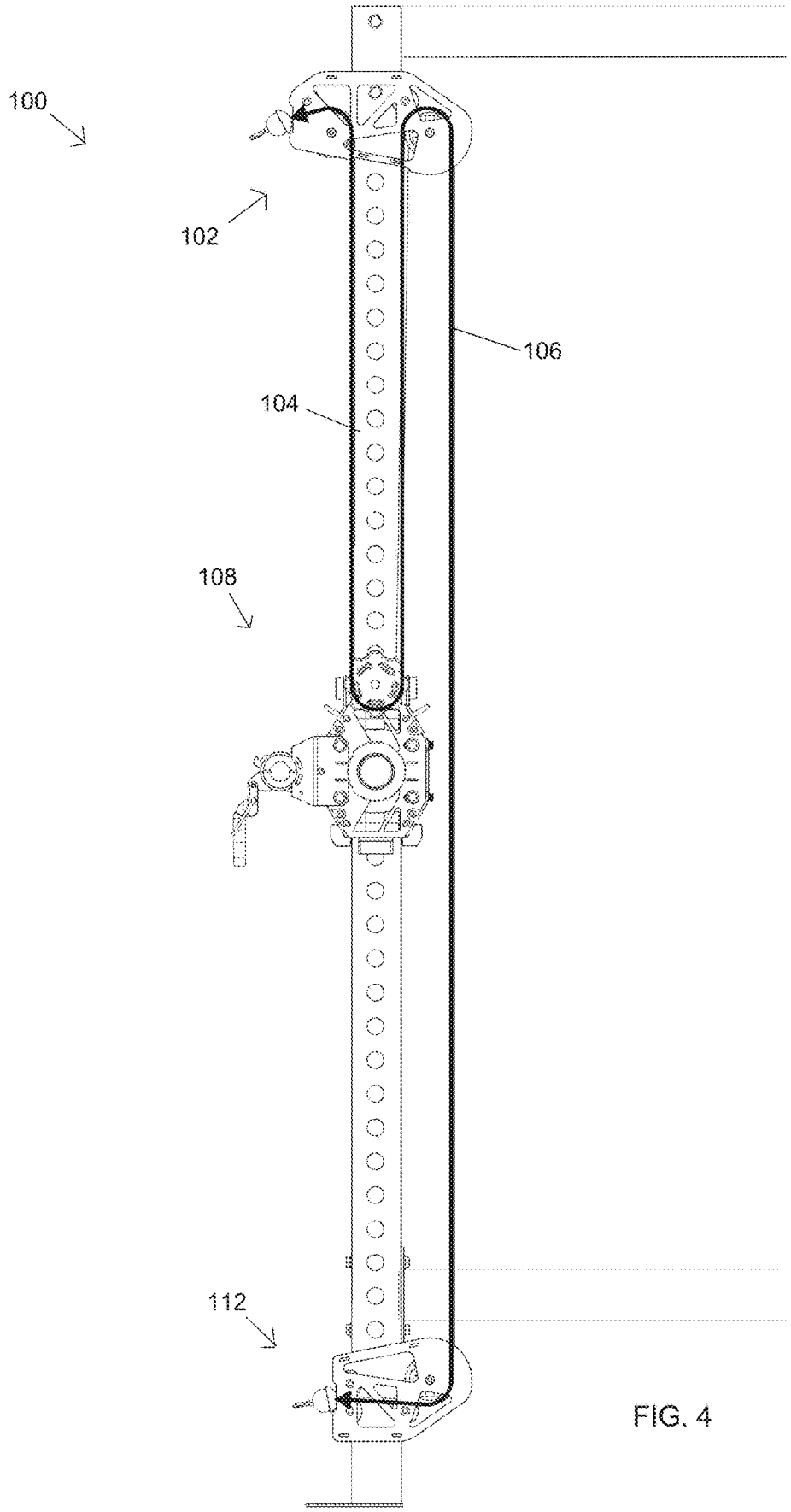
FIG. 4 is a side view of the rack pulley system of FIG. 1 demonstrating the path of travel of the cable.

Turning to FIG. 4, the path of the cable 106 is specifically shown, wherein the cable starts at upper pulley system 102, loops down to the trolley 108, loops back up to the upper pulley system 102 again, and then back down to the lower pulley system 112.

During operation, a user can add an attachment to the top end of the cable 106 and pull down, wherein the trolley 108 will then travel upward with resistance. Alternatively, the user can add an attachment to the bottom end of the cable 106 and pull upward, wherein again, the exerted force will cause the trolley 108 to travel upward with weighted resistance.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. An exercise machine having a rack pulley system, comprising:

a vertical post as part of the exercise machine;

an upper pulley system engaged with the vertical post, the upper pulley system having:

an upper housing mounted to an upper brace, the upper brace to engage with the vertical post; and a plurality of upper cable guides supported by the upper housing and configured to support a cable traveling therethrough;

a lower pulley system engaged with the vertical post at a position below the upper pulley system, the lower pulley system having:

a lower housing mounted to a lower brace, the lower brace to engage with the vertical post; and a plurality of lower cable guides supported by the lower housing and configured to support the cable traveling therethrough;

a trolley engaged with the vertical post and configured to traverse along the vertical post at a position between the upper pulley system and the lower pulley system, the trolley having a trolley cable guide configured to connect the trolley to the cable;

wherein the trolley cable guide allows for removal of the cable from the trolley such that the trolley can be used with or without the cable; and wherein the upper pulley system and lower pulley system are removable from the vertical post.

2. The exercise machine of claim 1, wherein the upper brace is configured to removably secure to the vertical post via one or more pins.

3. The exercise machine of claim 1, wherein the plurality of upper cable guides further comprises an upper guide and a lower guide, wherein the cable extends between the upper guide and the lower guide and travels downward from the lower guide toward the lower pulley system and an end of the cable extends from the upper guide and the lower guide.

4. The exercise machine of claim 2, wherein the plurality of upper cable guides further comprises an upper rear guide and a lower rear guide, wherein the cable extends between the upper rear guide and the lower rear guide and travels downward from the lower rear guide toward the lower pulley system.

5. The exercise machine of claim 1, wherein the plurality of lower cable guides further comprises an upper guide and a lower guide, wherein the cable extends between the upper guide and the lower guide and travels rearward to an upper rear guide and a lower rear guide and travels therebetween and an end of the cable extends from the upper guide and the lower guide.

6. The exercise machine of claim 1, wherein the cable travels from a first end to a second end, the cable starting at the first end at the upper pulley system, traveling through the upper pulley system to a first curve, then down to the trolley where the cable forms a second curve and travels back up to the upper pulley system and forms a third curve and then travels down to the lower pulley system wherein the cable will form a fourth curve such that the second end exits the lower pulley system.

7. The exercise machine of claim 1, wherein the trolley further comprises a weight sleeve configured to selectively receive weights.

8. The exercise machine of claim 1, wherein the trolley cable guide is removable to allow for removal of the cable therefrom.

9. A rack pulley system for use with an exercise machine, the rack pulley system comprising:

an upper pulley system configured to removably secure to a vertical post, the upper pulley system having:

an upper housing mounted to an upper brace, the upper brace to engage with the vertical post; and a plurality of upper cable guides supported by the upper housing and configured to support a cable traveling therethrough;

a lower pulley system configured to removably secure to the vertical post at a position below the upper pulley system, the lower pulley system having:

a lower housing mounted to a lower brace, the lower brace to engage with the vertical post; and a plurality of lower cable guides supported by the lower housing and configured to support the cable traveling therethrough;

a trolley configured to engaged with the vertical post at a position between the upper pulley system and the lower pulley system and configured to traverse along the vertical post at a position between the upper pulley system and the lower pulley system, the trolley having a trolley cable guide configured to connect the trolley to the cable;

wherein the trolley cable guide allows for removal of the cable from the trolley such that the trolley can be used with or without the cable.

10. The rack pulley system of claim 9, wherein the upper brace is configured to removably secure to the vertical post via one or more pins.

11. The rack pulley system of claim 9, wherein the plurality of upper cable guides further comprises an upper guide and a lower guide, wherein the cable extends between the upper guide and the lower guide and travels downward from the lower guide toward the lower pulley system and an end of the cable extends from the upper guide and the lower guide.

12. The rack pulley system of claim 11, wherein the plurality of upper cable guides further comprises an upper rear guide and a lower rear guide, wherein the cable extends between the upper rear guide and the lower rear guide and travels downward from the lower rear guide toward the lower pulley system.

13. The rack pulley system of claim 9, wherein the plurality of lower cable guides further comprises an upper guide and a lower guide, wherein the cable extends between the upper guide and the lower guide and travels rearward to an upper rear guide and a lower rear guide and travels therebetween and an end of the cable extends from the upper guide and the lower guide.

14. The rack pulley system of claim 9, wherein the cable travels from a first end to a second end, the cable starting at the first end at the upper pulley system, traveling through the upper pulley system to a first curve, then down to the trolley where the cable forms a second curve and travels back up to the upper pulley system and forms a third curve and then travels down to the lower pulley system wherein the cable will form a fourth curve such that the second end exits the lower pulley system.

15. The rack pulley system of claim 9, wherein the trolley further comprises a weight sleeve configured to selectively receive weights.

16. The rack pulley system of claim 9, wherein the trolley cable guide is removable to allow for removal of the cable therefrom.

* * * * *